US006053761A

United States Patent [19]

Baron et al.

[11] Patent Number: 6,053,761

[45] Date of Patent: Apr. 25, 2000

[54] SYSTEM FOR SMOOTHLY PLUGGING AND UNPLUGGING LARGE INPUT/OUTPUT CONNECTORS

[75] Inventors: Dominique Baron; Jean Conde; Bruno Centola, all of Vence, France

[73] Assignee: International Business Machines Corporation, Armonk, N.Y.

[21] Appl. No.: 09/085,432

[22] Filed: May 27, 1998

[30] Foreign Application Priority Data

Jun. 27, 1997 [EP] European Pat. Off. ..... 97480037

[51] Int. Cl.[7] ..... H01R 13/64

[52] U.S. Cl. ..... 439/378; 439/378; 439/157; 439/159; 439/310; 439/362

[58] Field of Search ..... 439/378, 157, 439/159, 160, 310, 362

[56] References Cited

U.S. PATENT DOCUMENTS

| | | | |
|---|---|---|---|
| 4,577,919 | 3/1986 | Waters | 439/59 M |
| 4,898,541 | 2/1990 | Lhuillier | 439/248 |
| 5,098,312 | 3/1992 | Raczynski | 439/362 |
| 5,125,849 | 6/1992 | Briggs et al. | 439/378 |
| 5,197,900 | 3/1993 | Ellis et al. | 439/352 |
| 5,391,091 | 2/1995 | Nations | 439/378 |
| 5,647,758 | 7/1997 | Ichikawa et al. | 439/362 |
| 5,859,766 | 1/1999 | Van Scyoc et al. | 361/752 |

*Primary Examiner*—Paula Bradley
*Assistant Examiner*—Truc Nguyen
*Attorney, Agent, or Firm*—Joscelyn G. Cockburn

[57] ABSTRACT

The present invention relates to cable-to-card connectors and more particularly to a system for simplifying plugging and unplugging operations and for preventing any risk of bending pins and damaging contacts first, by guiding the cable and receiving connectors and second by multiplying the operator's insertion/extraction force. The system comprises a pair of guiding posts one on each side of the cable connector and a push-pull unique central screw making the link between guiding posts and the cable connector.

10 Claims, 8 Drawing Sheets

SYSTEM FOR SMOOTHLY PLUGGING AND UNPLUGGING LARGE INPUT/OUTPUT CONNECTORS

TECHNICAL FIELD

The present invention relates to cable-to-card connectors and, more particularly, to a system for simplifying plugging and unplugging operations and for preventing any risk of bending pins and damaging contacts; first, by guiding male and female connectors; and second, by multiplying the operator insertion/extraction force.

BACKGROUND ART

Large Input/Output Connectors

The great progress realized these last years in the data processing technology now allows the interconnection of numerous sub-systems with a constantly growing number of input and output signals. The reduction of the overall size of connectors leads to increase of the density of both pins and contacts. However, higher is the number of transmitted signals per connection, more fragile and thinner are the pins and contacts. The standard connectors which are the most frequently used, are manually inserted. The retention of the cable connector is done mainly by means of mechanical devices such as screws, springs, embossing or different kinds of latching.

Inserting Force

FIGS. 1 to 4 show an overview of the particular problems encountered by the plugging and unplugging of large cable connectors. Large cable connectors (1) (more than 80 pins) are very often designed as an extension of small size connectors which, as for them, can be easily plugged and unplugged manually. But the insertion force is directly related to number of pins.

The improvement of the Radiated Frequency Interference (RFI), Electro-Static Discharge (ESD), Electrical Fast Transient (EFT) behaviour of large connectors requires additional contacts between male and female shells (16). These contacts are achieved due to special embossing or springs on the male shell which also have, by sliding friction, the adverse effect of drastically increasing the insertion force.

Therefore, it becomes very difficult for an operator to smoothly insert and remove such assemblies. As described in FIG. 2, the operator is forced to plug and unplug the pins sequentially, by applying a kind of wavy motion. But, since the pins are very fragile, this kind of un-straight motion may lead to contact damages (6) and indirectly to machines misfunctions as show in FIG. 4.

The connector latching systems very often increases the above problem. As shown in FIG. 1, the retention system, the most frequently used, consists of a couple of screws (3) which fit in threaded studs (4) on the receiving connector (2). Most of time, the operator does not have the force to plug completely the connector and to complete the job, he uses the retention screws (3) or other plugging tools. Instead of turning the two screws at the same time, the operator tightens screws one after the other, which does not move the cable connector straightly, but with an angle as shown in FIG. 3. Pins follow the same motion and go in sockets with a wrong orientation which bends pins (5) and opens female sockets (6) (FIG. 4).

A system adapted to connectors having a small number of I/O is not endlessly expendable to large connectors. There is a limit which depends upon several different parameters:

connector shape, accessibility, contact technology, operator, etc.

To give an approximate limit, when the insertion force is above approximately 20 kg, an assisted device is highly recommended for plugging or unplugging male and female connectors.

SUMMARY OF THE INVENTION

Plugging and Unplugging Operations

First, to prevent the risk of damaging contacts male and female contacts must be plugged/unplugged by means of a linear translation, without any leading angle. Connectors must move straight without any rotation as shown in FIG. 1. Thus, A guiding device (also known as guiding structure or guiding assembly) is required for placing and maintaining the male and female connectors lined up during the connection/disconnection operations.

Second, the insertion force of connectors with large number of pins is very important. Most operators have difficulties to plug or unplug male and female connectors. A device for multiplying the force of operators is required for exercising enough pressure to insert the connectors or enough force to separate the connectors.

Finally, to avoid any tilting of connectors while their insertion or extraction, the force must be applied in the connectors axis.

The object of the present invention is to smoothly plug and unplug large input/output connectors without bending pins and damaging contacts.

It is a further object of the invention to:

guide the cable and receiving connectors, multiply the operator's insertion/extraction force and center the forces on the connectors axis.

It is another object of the invention to design a cable connector which can be smoothly plugged and unplugged on standard receiving connectors.

The cable connector comprises a fixed part with placing and maintaining means and a movable part ensuring electrical contacts with the receiving connector. The fixed part comprises pushing and/or pulling means for pushing and/or pulling the movable part of the cable connector. The placing and maintaining means comprise guiding posts to be fixed to the receiving connector and on which the movable part of the cable connector can freely slide.

DESCRIPTION OF THE PREFERRED EMBODIMENT

Plugging and Unplugging Device

The system for smoothly plugging and unplugging connectors according to the present application consists of a special device installed on the cable connector. As described in FIGS. 5 to 8, said device comprises two key elements:

1. a pair of guiding posts (10–11) one on each side of the cable connector (1),
2. a push-pull unique central screw (12–13) making the link between guiding posts and the cable connector (1) itself.

The cable connector (1) (shell and contacts) is a regular commercial item as the receiving connector (2) on the data equipment.

Guiding Posts

Figure 1:
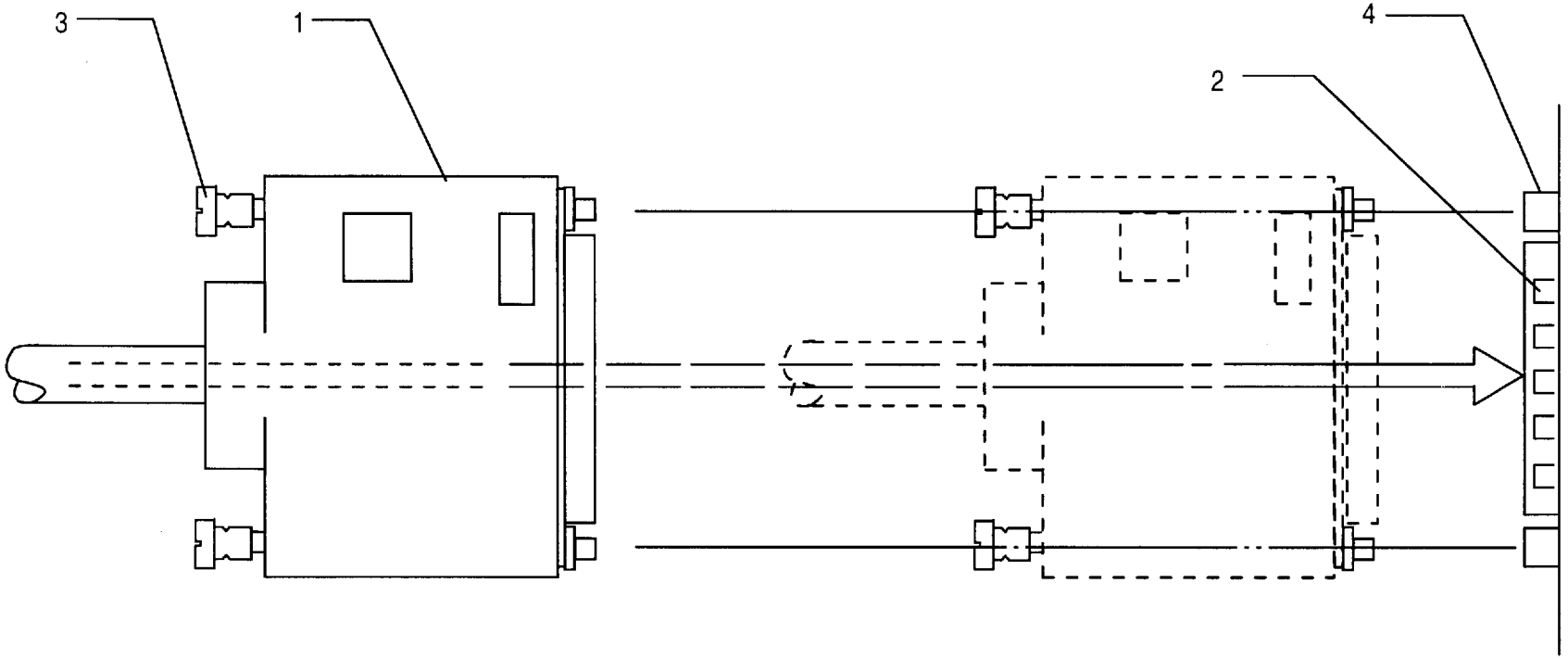
FIG. 1 PRIOR ART
FIG. 1 is a view of a theoretical good plugging motion according to prior art.
Figure 2:
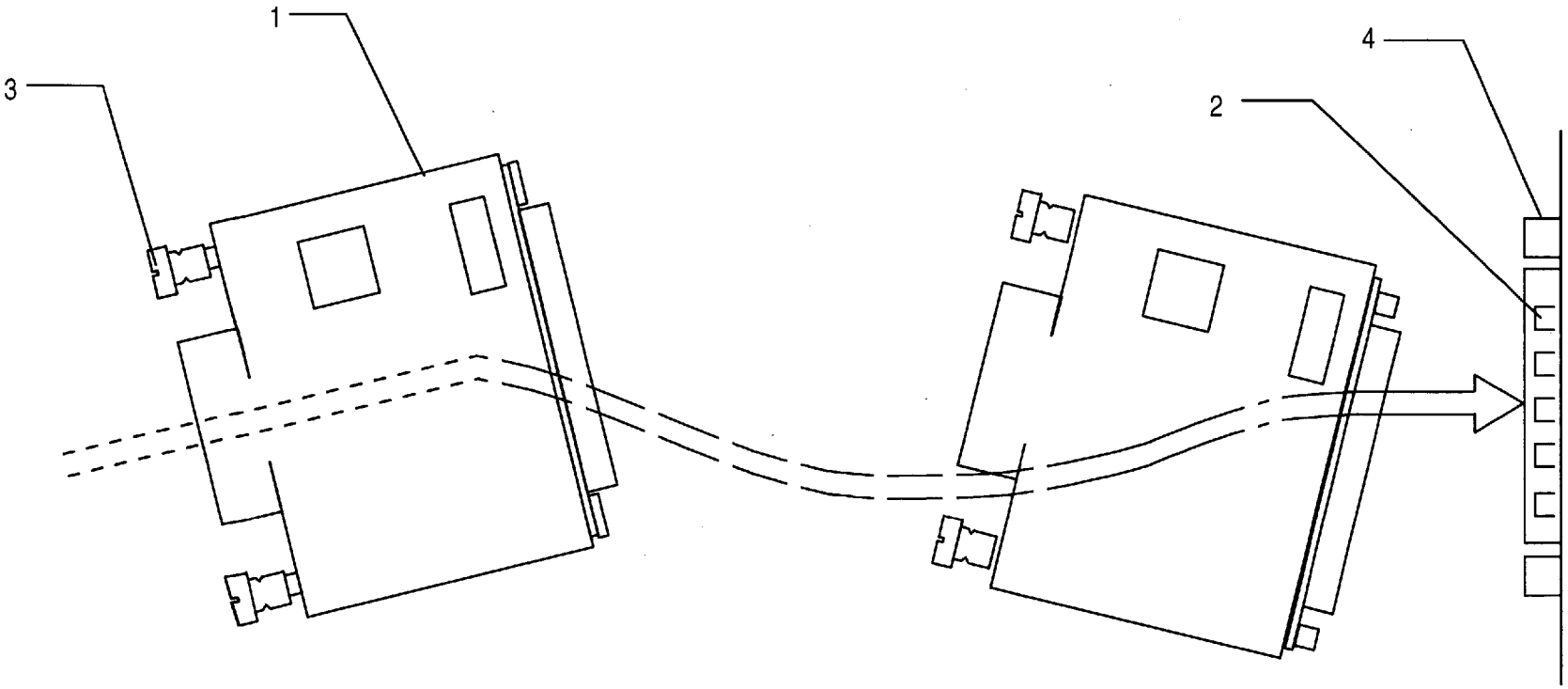
FIG. 2 PRIOR ART
FIG. 2 is a view of a realistic and current bad plugging motion according to prior art.
Figure 3:
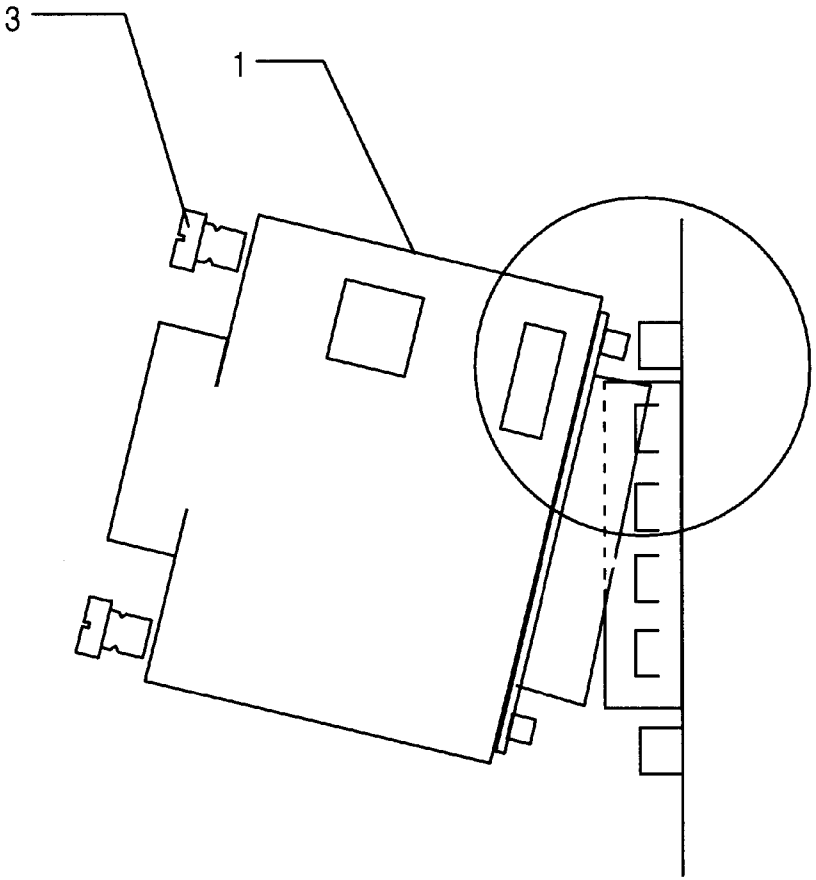
FIG. 3 PRIOR ART
FIG. 3 is a view of a realistic and current bad contact mating according to prior art.
Figure 4:
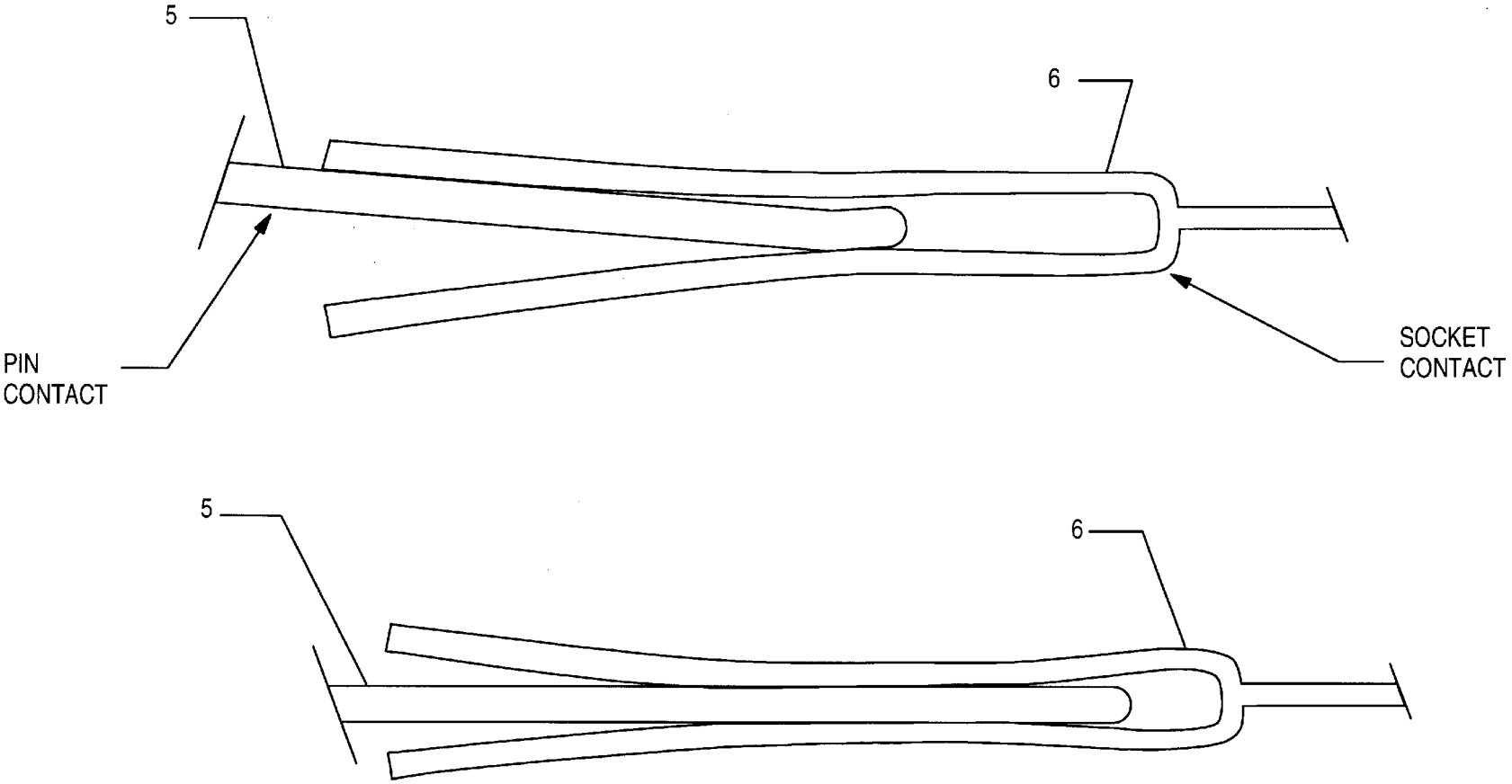
FIG. 4 PRIOR ART
FIG. 4 is a view of a damaged and non damaged contacts according to prior art.
Figure 5:
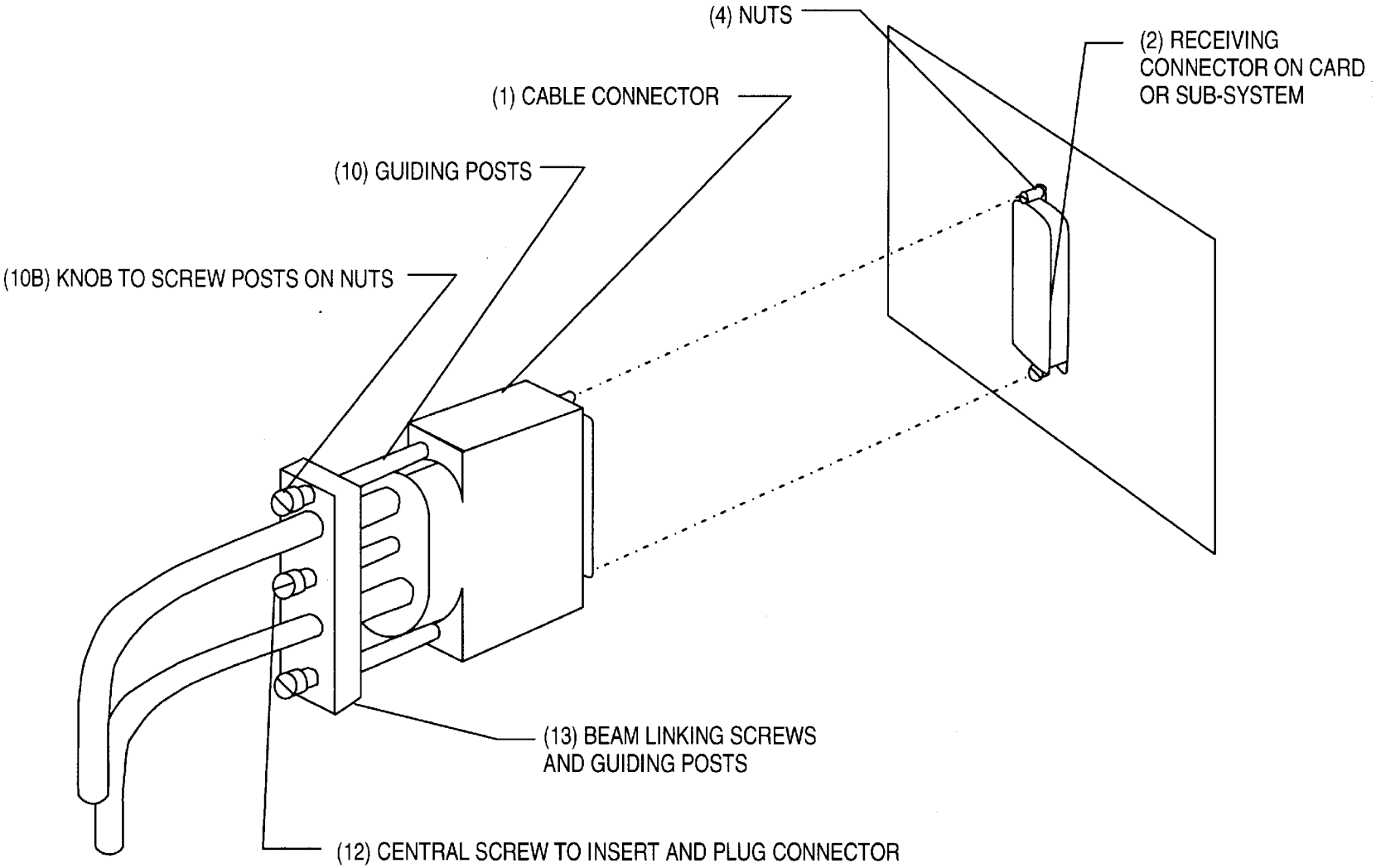
FIG. 5 is a view in perspective of a connector comprising inserting and guiding means according to the present invention.
Figure 6:
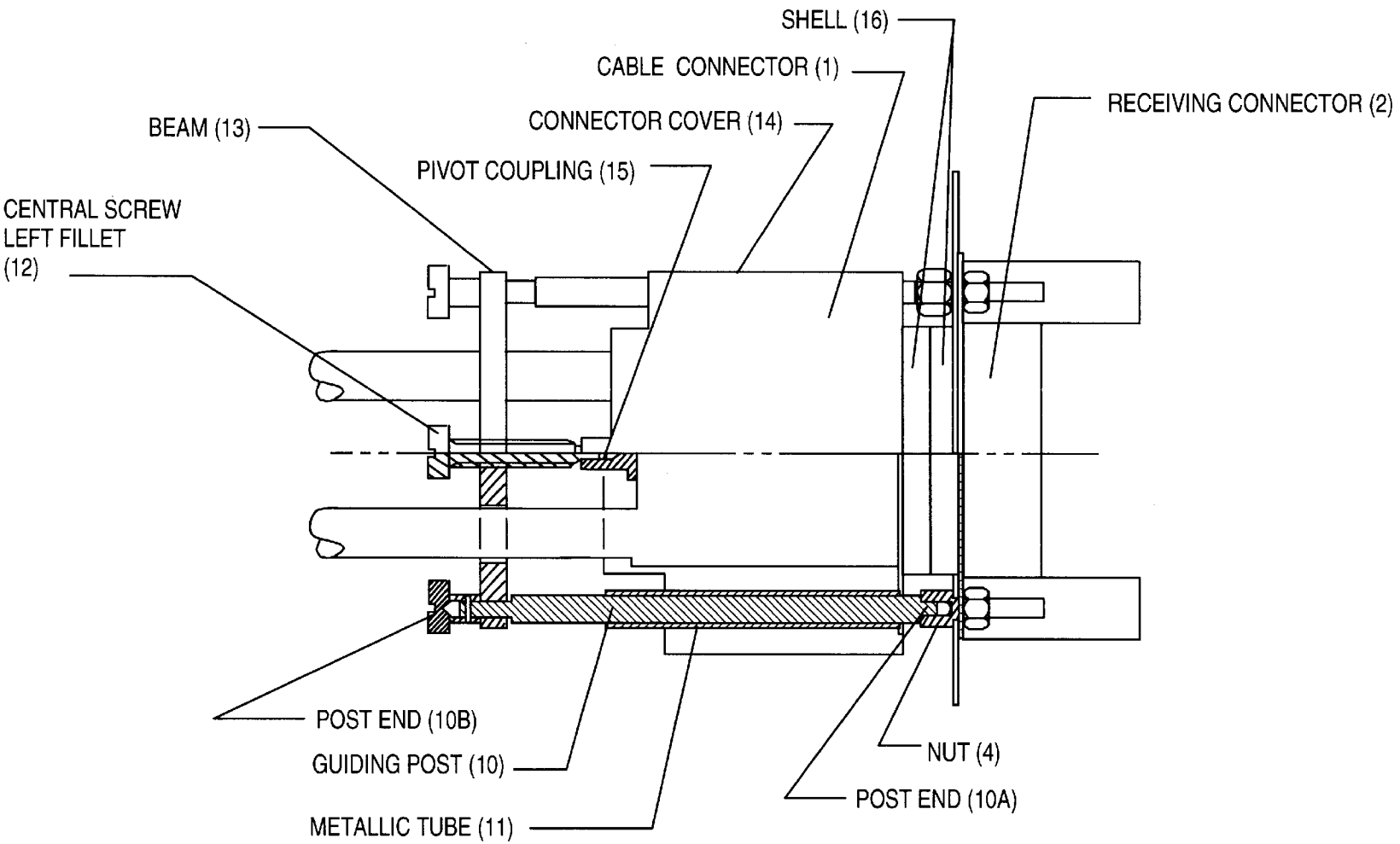
FIG. 6 is a partial section of the cable connector according to the present invention partially inserted in the receiving connector.
Figure 7:
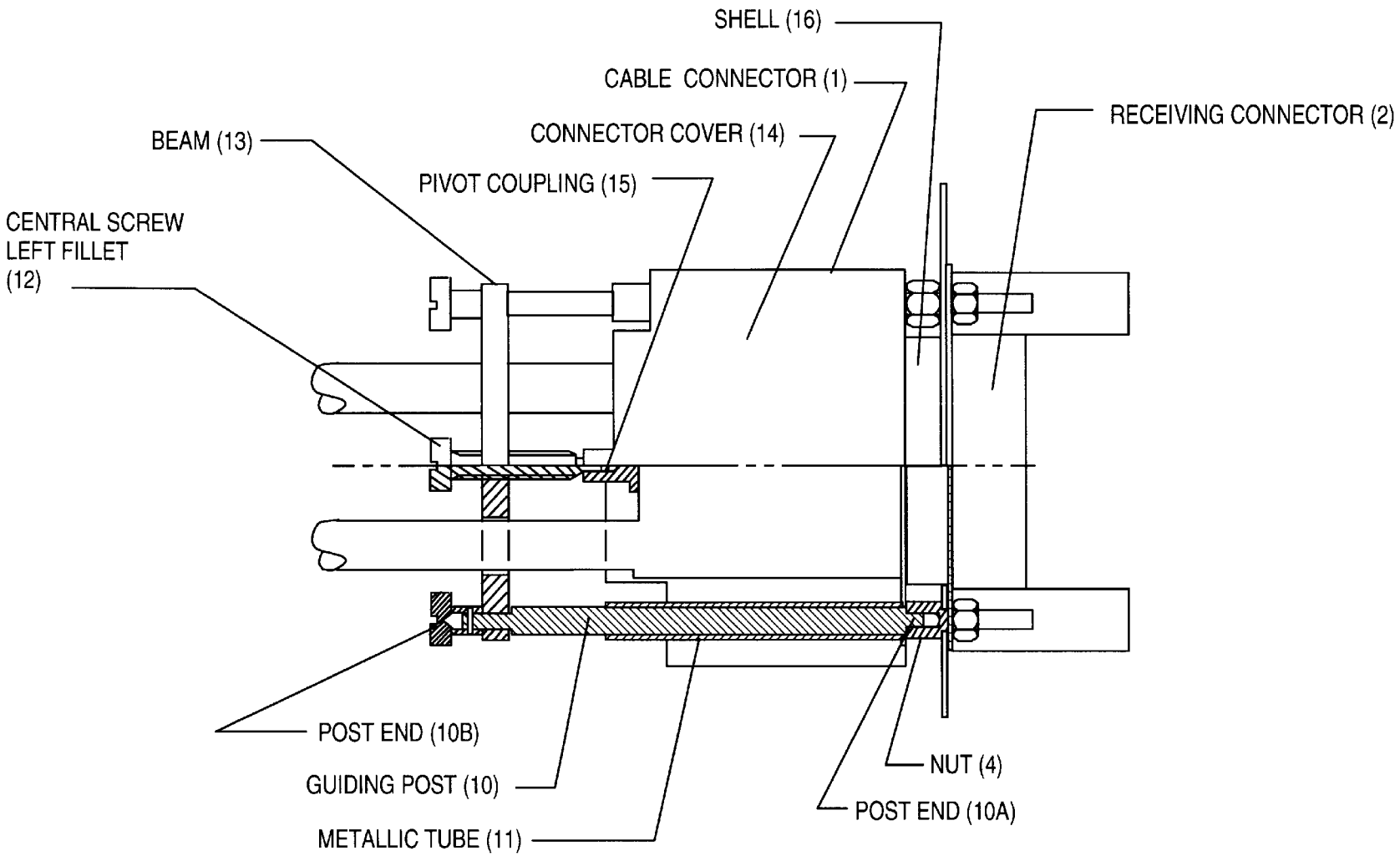
FIG. 7 is a partial section of the cable connector according to the present invention completely inserted in the receiving connector.

On each side of the cable connector, a post (10) is installed through the connector shell (16) and cover (if any). The cable connector is able to slide on the posts, which can also freely move in rotation. As shown in FIGS. 6 and 7, post (10) is guided by a metallic tube (11) which improves the guiding accuracy and stiffen parts. Post ends (10*a*) on connector sides are threaded to fit in counterparts nut (4) counterparts installed on the receiving connector (2). The threaded post ends and nuts firmly hold the cable connector and receiving connector. Other post ends (10*b*) are designed in such way operator can turn them by hand and/or with a tool.

Push-pull Screw Device

The force to insert or extract the connector cable is handled by a unique central screw (12). The screw is positioned in the connector axis, one side being attached on a fix part (13) of the cable connector and the other side being attached on a movable part of the cable connector (the connector cover (14)) by means of pivot coupling 15.

The rotation of said screw allows the cable connector to move along the two guiding posts (10) and to insert or disconnect the two connectors (1 and 2). The translation is obtained due to the central screw rotating, on one side, in a threaded hole through the fix part of the cable connector (transversal beam (13)), and on another side, in a pivot coupling (15) located on the movable part of the cable connector (connector cover (14)). The pivot coupling is made of male/female shapes, rotation free but translation locked by a retaining spring ring.

This screw is centered in cable connector to give translation effort in the axis without creating a rotation torque and a tilting of the connector and thus without damaging the contacts. The screw (12) has a left fillet to insert the cable connector when the operator turns it clockwise and to disconnect the connector when the operator turns it counterclockwise.

Plugging Operation

As described in FIGS. 6 and 7, the plugging operation comprises the following steps:

1. The cable connector (1) is first positioned all the way close to the transversal beam (13) by turning the central screw counterclockwise.
2. The cable connector is then placed against the receiving connector (2).
3. The two guiding posts (10) are screwed onto the receiving connector fastening nuts (4). The ideal way is to fasten the two screws at same time, but even if the operator tightens one post and then the other, there is no risk of part damages, both connectors being not in contact at that time.
4. After guiding posts (10) are installed, the central screw (12) is turned to move forward the cable connector and to insert it in its receiving counterpart. The screw pushes the cable connector in the axis and in straight line with the help of the guiding posts. The pins (5) are smoothly inserted in the sockets (6) without damages. The plugging operation requires no specific operator's effort, the central screw does the job.

Unplugging operation

Figure 8:
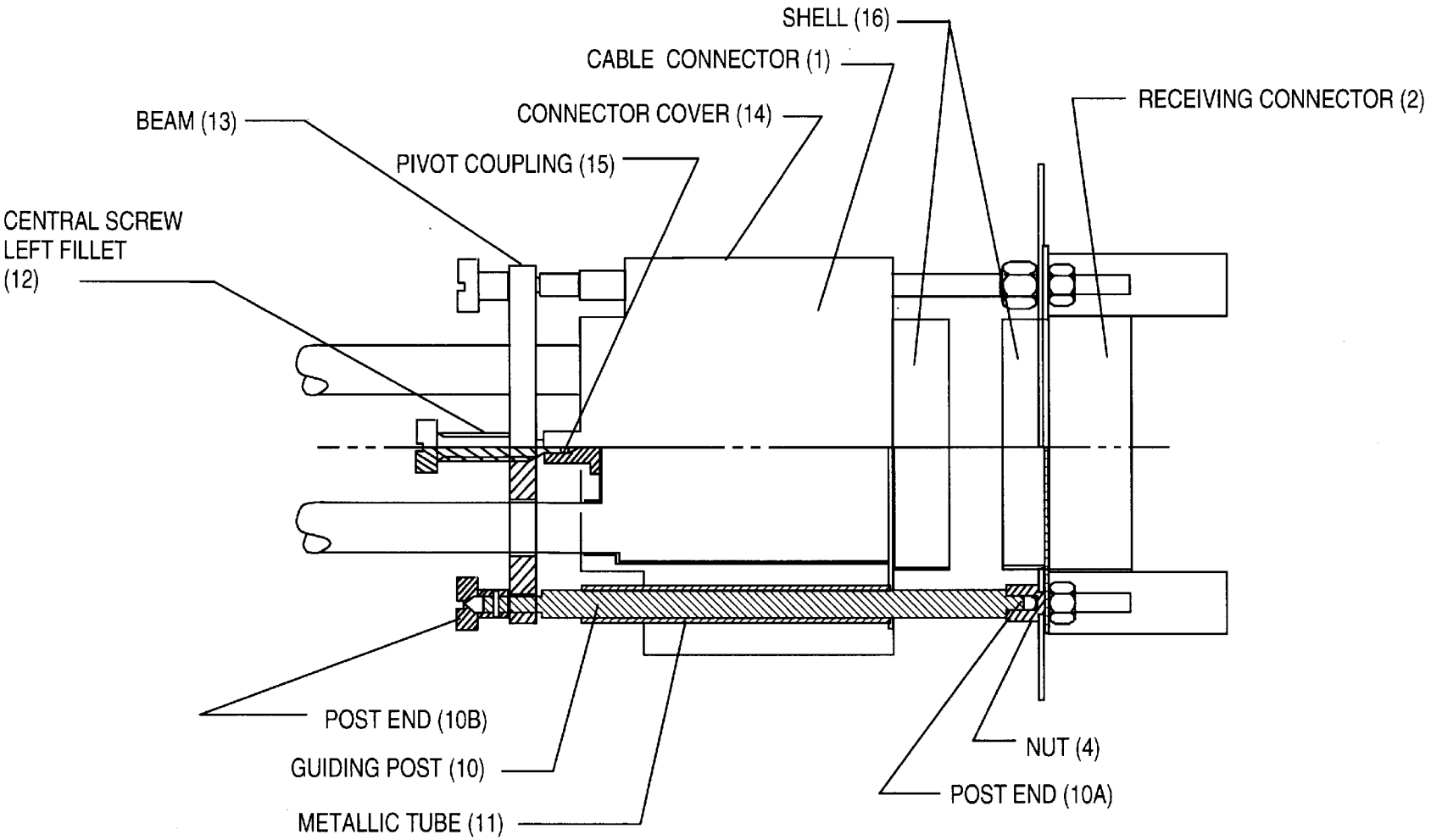
FIG. 8 is a partial section of an unplugged connector according to the present invention.

As shown in FIG. 8, the unplugging operations comprises the following steps:

1. The central screw (13) is turned counterclockwise until the cable connector (1) is disconnected from the receiving connector (2).
2. The two guiding posts (10) are turned counterclockwise and released.
3. The cable connector (1) is now fully released from the sub-system.

The push-pull device is back to its initial position, ready to be plugged again.

While the invention has been particularly shown and described with reference to a preferred embodiment thereof, it will be understood by those skilled in the art that various changes in form and details may be made therein without departing from the spirit and scope of the invention.

Having thus described our invention, what we claim as new and desire to secure by Letters Patent is:

1. A cable assembly including:

a beam;

a cable connector with electrical contacts thereon;

a guiding assembly, operatively coupled to the beam and the cable connector, that constrains the cable connector to be displaced along a linear trajectory;

a pivot coupling operatively mounted on the connector;

a receptacle operatively mounted to the pivot coupling;

a screw mounted to the beam and operatively co-acting with the receptacle to apply force to said connector to move said connector along the linear trajectory on the guiding assembly.

2. The cable assembly of claim 1 further including a receiving connector with electrical contacts for mating with the electrical contacts on said cable connector.

3. The cable assembly of claim 2 further including a device that firmly holds the cable connector and the receiving connector together.

4. The cable assembly of claim 3 wherein the device includes threaded nuts disposed on the receiving connector.

5. The cable assembly of claim 1 wherein the cable connector includes a housing with a pair of metallic tubes disposed in spaced relationship in said housing.

6. The cable assembly of claim 5 wherein the guiding assembly includes a pair of guiding post with one of said pair being inserted in one of the metallic tubes.

7. The cable assembly of claim 6 wherein each guide post includes a threaded portion, for mating with a mechanical structure, on one end and means for turning said each guide post fabricated on another end.

8. The cable assembly of claim 5 wherein the screw is entered and positioned on a central axis equal distance from each one of the metallic tubes.

9. A cable assembly including:

a cable connector having a housing with electrical contacts mounted thereon;

a beam;

a pair of metallic tubes disposed in spaced relationship in said housing;

a pair of linear guide posts with one of said pair being inserted in the one of the metallic tubes and each one of said linear guide post having a threaded portion at one end and a thumb piece at the other end;

a pivot coupling operatively mounted on the connector;

a receptacle operatively mounted to the pivot coupling;

a screw mounted to the beam and operatively co-acting with the receptacle to apply force to said connector to move said connector along a linear path on the guiding assembly.

10. The cable assembly of claim 9 further including a receiving connector having a housing with electrical contacts mounted thereon; and a pair of threaded nuts, disposed in spaced relationship on said receiving connector housing, for receiving the threaded portion to hold the cable connector and the receiving connector firmly together.

* * * * *